United States Patent [19]

Speck

[11] Patent Number: 4,673,006

[45] Date of Patent: Jun. 16, 1987

[54] APPARATUS AND METHOD FOR REMOVING LIQUID FROM AND CLEANING A CONTAINER

[75] Inventor: Cleo T. Speck, Indianola, Iowa

[73] Assignee: Herschel Corporation (Delaware Corp.), Indianola, Iowa

[21] Appl. No.: 764,771

[22] Filed: Aug. 12, 1985

[51] Int. Cl.[4] ..... B65B 3/00; B07D 5/54

[52] U.S. Cl. ..... 141/1; 141/65; 141/91; 137/892; 366/150

[58] Field of Search ..... 366/150; 137/892; 141/1, 85–92, 65, 66

[56] References Cited

U.S. PATENT DOCUMENTS

| | | | |
|---|---|---|---|
| 3,357,598 | 12/1967 | Kraft | 137/892 |
| 4,344,469 | 8/1982 | Brown | 137/892 |
| 4,534,083 | 8/1985 | Hampson | 137/892 |

*Primary Examiner*—Houston S. Bell, Jr.

*Attorney, Agent, or Firm*—Merchant, Gould, Smith, Edell, Welter & Schmidt

[57] ABSTRACT

The present invention is directed to a liquid transfer apparatus. The apparatus draws a first liquid from a container to a low pressure region created when a second pressurized liquid is directed through a venturi nozzle. The first and second liquids combine downstream from the venturi nozzle to flow to a destination tank. The apparatus includes a T-shaped conduit structure wherein the pressurized liquid passes through the first or cross conduit. The first liquid in the container is drawn up the second conduit which forms the leg of the structure. A bypass conduit connects between the first conduit near the inlet end and a sleeve surrounding the second conduit. The sleeve includes openings around the periphery such that when valves are appropriately positioned, pressurized liquid is forced out the openings and may be used to flush and clean the interior of the container of the first liquid.

13 Claims, 3 Drawing Figures

APPARATUS AND METHOD FOR REMOVING LIQUID FROM AND CLEANING A CONTAINER

FIELD OF THE INVENTION

The present invention is directed to a device for removing a first liquid from a container and mixing it with a second liquid. The device is particularly appropriate for removing a concentrate solution, such as a herbicide or an insecticide, from a shipping container without lifting the container and pouring. The device directs the second liquid, such as water, through a venturi, to create a low pressure region into which the first liquid, such as the concentrate, is drawn for mixing and flowing to an outlet.

BACKGROUND OF THE INVENTION

There are many situations where a first liquid in a container must be removed and mixed with a second liquid. Generally, the first liquid is a concentrate of some type and is contained in a shipping container. A typical situation involves the five gallon buckets filled with herbicides or insecticides of a type used in sprayer implements on farms. The farmer usually removes a cap from a spout or opening in the top of the container, lifts the container and pours the liquid concentrate therein into a tank on the sprayer implement. Water is usually added to obtain the desired concentration. The buckets are heavy, and oftentimes the liquid contents are dangerous. In addition, the agricultural implement is often large. Thus, the difficulty of transfering the liquid concentrate from the five gallon shipping container to the implement mixing and/or holding tank often involves manual lifting, carrying and moving the bucket to the top of the implement, sometimes up a ladder or along a catwalk. The contents of the bucket are poured into the mixing tank, many times resulting in partially or completely missing the inlet opening, having such results as loss of expensive concentrate, contamination of surrounding area and splashing of the concentrate on the operator, thereby creating a health hazard. In addition, the pouring of concentrate from a container usually results in an incomplete emptying of the container. That is, surface adhesion of the concentrate to the interior walls of the container and container design often result in various amounts of residue remaining in the container. The loss of such residue can be both expensive and hazardous.

The present invention is directed to providing an inexpensive and efficient device for eliminating the problems and dangers of the indicated representative procedure.

SUMMARY OF THE INVENTION

The present invention is directed to apparatus for removing a first liquid from a container to a designated destination. The apparatus is connected at an inlet to a pressurized source of a second liquid. The apparatus includes a first conduit having inlet and outlet ends. The inlet end is connected to the pressurized source and the outlet end directs both first and second liquids to the designated destination. The first conduit includes a mechanism for increasing flow velocity of the second liquid, followed by a mechanism for decreasing flow velocity. The apparatus further includes a second conduit which has an open end for placing into the first liquid in the container. There is a mechanism for connecting the second conduit to the first conduit, which provides for fluid communication from the second conduit to the first conduit. In this way, the velocity increasing mechanism creates a low pressure region in the second conduit which causes the first liquid to be drawn through the second conduit to the first conduit for mixing with the second liquid and flowing to the outlet end of the first conduit.

More particularly, the first conduit includes a first on/off valve upstream from a venturi nozzle. A second conduit is connected to the first conduit in a region near the nozzle. The fast flow of the first liquid through the nozzle creates the low pressure region about the nozzle and draws the first liquid from the container through the second conduit into the low pressure region and into the stream of first liquid being ejected from the venturi nozzle. Downstream from the nozzle is an ever expanding interior wall of the first conduit which decreases the flow speed of the mixing first and second liquids. A check valve preceeds the outlet end of the first conduit.

The apparatus is particularly advantageous, since for situations wherein it is desired to mix the first liquid with the second liquid, such mixing occurs as a part of the process of removing the first liquid from its container while at the same time providing flow energy for the mixed first and second liquids to proceed toward a destination. Thus, a concentrated liquid may be removed from its shipping container and mixed with water or some other dilutant liquid and directed into a holding container. Such an operation is possible simply by placing the open end of the second conduit in the concentrate or first liquid and opening the first on/off valve to allow the pressurized second liquid, usually water, to flow through the first conduit and particularly the venturi nozzle. The hazards of lifting, carrying, pouring, spilling, etc. are minimized, if not eliminated.

An additional feature of the present invention includes a third or bypass conduit leading from the first conduit upstream from the first on/off valve to a sleeve surrounding at least a portion of the second conduit. A second on/off valve is located in the bypass conduit. The sleeve includes openings all the way around its outer wall. When the shipping container is emptied of the first liquid, the first on/off valve is closed and the second on/off valve may be opened. The pressurized liquid then flows through the bypass conduit to the sleeve and is directed out the openings in a 360 pattern. By moving the apparatus from bottom end to top end in the container several times, the sidewalls are sprayed with the second liquid and, consequently, washed. If the openings are directed somewhat upwardly, the top of the container is likewise washed. When the second on/off valve is closed, the wash liquid solution is then removed from the container in the same fashion as the concentrate or first liquid was removed.

Thus, the present apparatus is not only advantageous for removing a concentrate liquid from a shipping container, but it is also advantageous for flushing and cleaning a container to minimize the hazard of a contaminated empty contaianer. Such flushing and cleaning furthermore results in recovery of what would otherwise be lost residue left in the shipping container.

DETAILED DESCRIPTION OF THE PREFERRED EMBODIMENT

Figure 1:
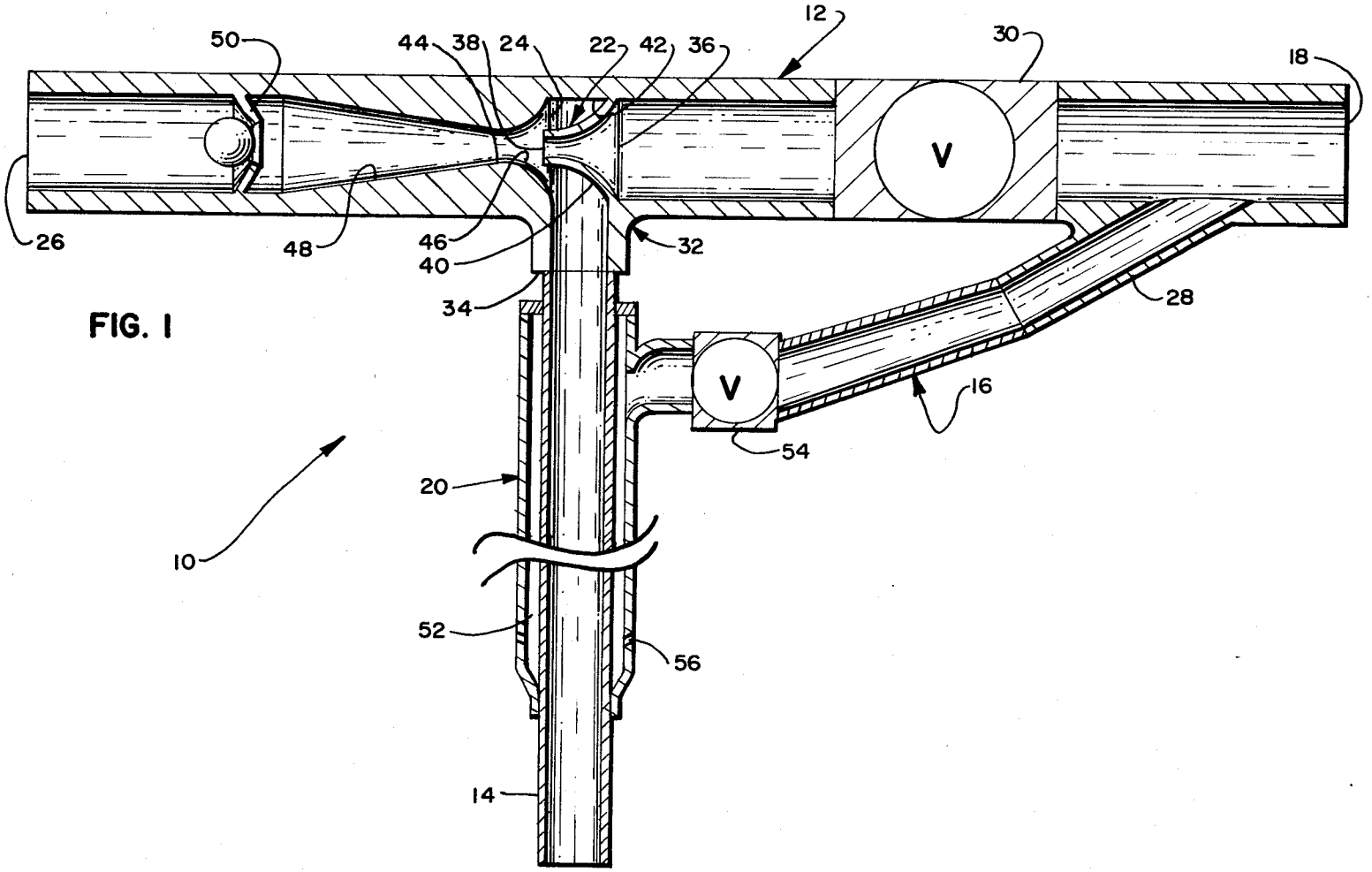
FIG. 1 is a cross-sectional, elevational view of an apparatus in accordance with the present invention.

Referring now to the drwings, wherein like reference numerals designate identical or corresponding parts throughout the several views, and more particularly to FIG. 1, an apparatus in accordance with the present invention is designated generally by the numeral 10. Apparatus 10 includes a first conduit 12 for connection to a source of pressurized second liquid and a second conduit 14 connected thereto to form generally a T-shape, the open end of which is placed in a first liquid. A third or bypass conduit 16 extends from near the inlet end 18 of the first conduit 12 to a sleeve 20 surrounding a portion of the second conduit 14. First conduit 12 includes a venturi nozzle 22 about which a region 24 of low pressure is created when the second liquid flows through nozzle 22. The low pressure draws the first liquid up second conduit 14 to mix with the second liquid for flow from outlet opening 26 of first conduit 12.

In proceeding from inlet end 18 to outlet end 26, first conduit 12 includes a Y formation 28 for connection with bypass conduit 16. Following Y formation 28, a first on/off valve 30 is connected in a known fashion. From first on/off valve 30, first conduit 12 proceeds to a Tee-like connection 32, the base 34 of which is connected to second conduit 14. Preferably, just above base 34 is located venturi nozzle 22. Nozzle 22 has length from an inlet end 36 to an outlet end 38 of approximately the diameter of base 34. The length of nozzle 22 is preferably centered on base 34. The wall 40 of nozzle 22 is spaced from the interior wall 42 of first conduit 12. The separation between nozzle wall 40 and interior wall 42 forms space 24 which becomes a low pressure region when pressurized liquid flows through nozzle 22.

Proceeding along first conduit 12 toward outlet opening 26 from venturi nozzle 22, interior wall 42 is preferably formed to have a restriction 44 about the size of or slightly larger than outlet end 38 of nozzle 22 and is spaced a slight distance downstream from outlet end 38. Upstream from restriction 44, interior wall 42 rather sharply flares to its normal diameter to form space 24 as indicated hereinbefore. The first liquid which is drawn up second conduit 14 flows between flare 46 and nozzle 22 to be entrained and mixed with the stream of second liquid ejecting from nozzle 22. Proceeding downstream from restriction 44, wall 42 forms a region 48 of decreasing flow velocity. In particular, wall 42 has a slow, but ever increasing diameter until its diameter becomes approximately the same as the interior diameter of first conduit 12 upstream from venturi nozzle 22. A check valve 50 is located between region 48 and outlet end 26.

Second conduit 14 is preferably a straight pipe extending downwardly from connection with base 34 of item 32.

Sleeve 20 is fastened to and surrounds a portion of second conduit 14. Sleeve 20 provides a concentric space 52 around second conduit 14. Bypass conduit 16 is connected to and extends between Y-fitting 28 and sleeve 20 to provide fluid communication between first conduit 12 upstream from first on/off valve 30 and space 52. Second on/off valve 54 is installed in a known fashion in bypass conduit 16. Sleeve 20 includes a plurality of openings 56 near the lower end of sleeve 20 so that liquid moving into sleeve 20 is ejected out the openings. Preferably, the center of the openings represented by a center line or an imaginary center surface is inclined from inside to outside toward first conduit 12. With respect to a plane perpendicular to the axis of second conduit 14, openings 56 are inclined preferably at 15.

Figure 2:
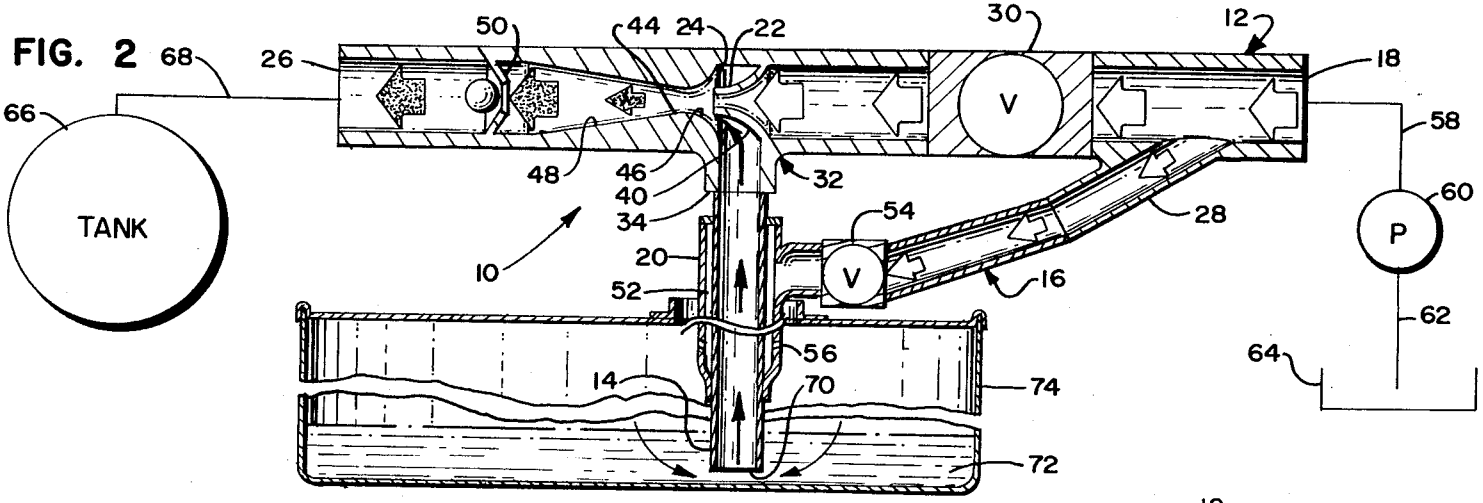
FIGS. 2 and 3 are cross-sectional, elevational views illustrating use of the present invention.
Figure 3:
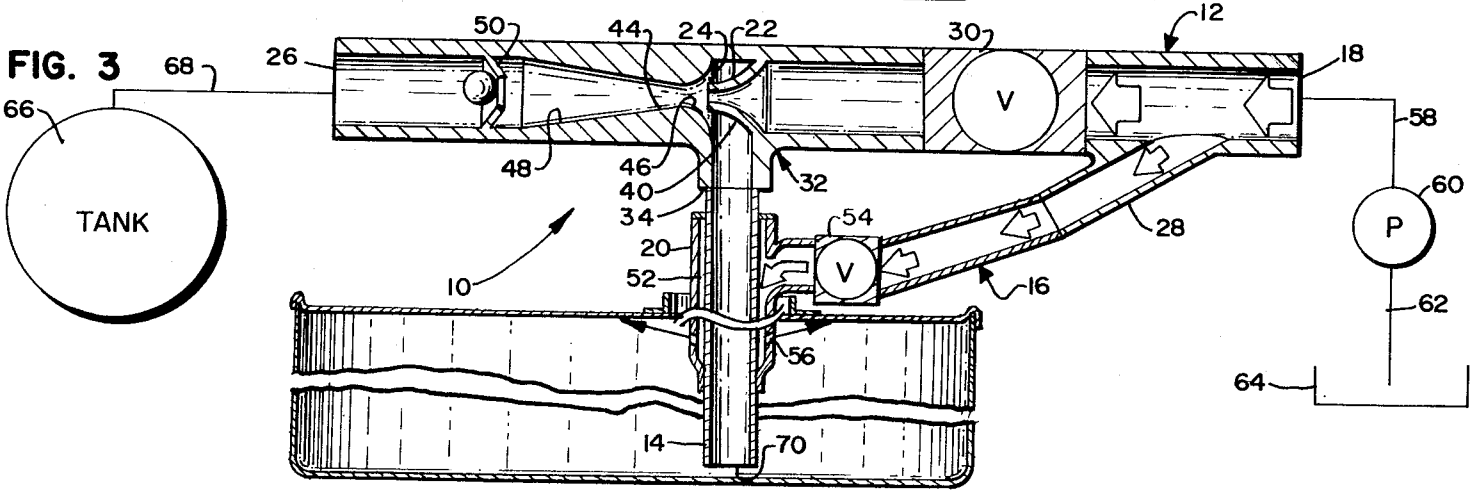

In use, as shown in FIGS. 2 and 3, inlet end 18 of first conduit 12 is connected to a source of pressurized liquid. As shown in FIGS. 2 and 3, inlet end 18 is connected via line 58 to pump 60 which in turn is connected via line 62 to a reservoir 64. The outlet end 26 of first conduit 12 is directed to or connected with a designated destination for the combined liquids. As shown in FIGS. 2 and 3, outlet end 26 is connected to a holding tank 66 via line 68.

The open end 70 of second conduit 14 of apparatus 10 is placed in the concentrate or first liquid 72 in container 74. Container 74 is typically a five gallon can or some other type of shipping container. Such containers usually have a small opening in the top to which a spout may sometimes be attached. In any case, the tubular structure of second conduit 14 at sleeve 20 is particularly appropriate for getting through such small openings. With both first and second on/off valves in an off position, the second pressurized liquid from reservoir 64 and pump 60 is stopped at the valves. When first on/off valve 30 is opened, the second liquid flows through first conduit 12. The second liquid flows from first on/off valve 30 through the flow velocity increasing mechanism of venturi nozzle 22 and on past restriction 44 to the flow velocity decreasing region 48. From region 48, flow continues through check valve 50 and out outlet end 26 to piping 68 and tank 66. The flow of the pressurized or second liquid is depicted in the figures by unshaded expanded arrows. The flow of first liquid from container 74 as it is drawn up second conduit 14 to the reduced pressure region 24 around venturi nozzle 22 is depicted by line arrows. Flow of a mixture of the first and second liquids downstream from venturi nozzle 22 is depicted by expanded shaded arrows. As long as first on/off valve 30 is open and open end 70 of second conduit 14 is in first liquid 72, the first liquid will be drawn up by the low pressure region for mixture with the increased velocity first liquid ejecting from the nozzle 22. The first liquid drawn into the low pressure region 24 proceeds between flare wall 46 and the outlet end of nozzle 22 to mix with the second liquid in the region of restriction 44. The mixed liquids flow from restriction 44 through the velocity decreasing region before exiting through check valve 50 and outlet opening 26.

It is apparent that the present apparatus, thus, is capable of substantially emptying first liquid 72 from container 74 without the operator ever lifting or carrying the container 74 or pouring from container 74.

When all but a small residue of first liquid has been removed from container 74, first on/off valve 30 is closed and second on/off valve 54 is opened as shown in FIG. 3. The pressurized liquid now flows through bypass conduit 16 and second on/off valve 54 to sleeve 20 about second conduit 14. The second liquid fills space 52 in sleeve 20 and flows out openings 56 in a 360° pattern about the axis of second conduit 14 and sleeve 20. By moving apparatus 10 up and down, the second liquid is directed out openings 56 against the entire vertical length of the sidewalls of container 74. Also, by bringing openings 56 close to the opening in the top of container 74, the second liquid is directed out openings 56 against the interior top of container 74 as shown in FIG. 3. Once efficient washing of the interior of container 74 has been done, the second on/off valve 54 is closed and the procedure for removing a first liquid contained in container 74 is again used to remove the first liquid to a destination such as tank 66. The flushing of container 74 may be done as many times as desired to remove most of the residue from container 74.

Thus, apparatus 10 is not only capable of removing a liquid such as a concentrate from a shipping container without pouring the liquid from the container, but it is also capable of flushing the interior of the container. Furthermore, such advantages are obtained with a minimum of moving parts. A conventional check valve and conventional on/off valves, as well as a pump, are all that is needed. Operation of the apparatus is simple and quick and accomplished by a single individual. Use of the apparatus distinctly minimizes spillage and attendant risks to good health. Furthermore, the apparatus provides a mechanism for cleaning the shipping containers, thereby further reducing the risk of a hazardous disposal item.

Although advantages have been set forth and a preferred embodiment described in detail, it is, nevertheless, understood that the disclosure is exemplary. Consequently, changes made, especially in matters of shape, size and arrangement, to the full extent extended by the general meaning of the terms in which the appended claims are expressed, are understood to be within the principle of the present invention.

What is claimed is:

1. Apparatus for removing a first liquid from a container, said apparatus being connected to a pressurized source of a second liquid, said apparatus comprising:

(a) a first conduit having inlet and outlet ends, said first conduit being connected to said source at said inlet end, said first conduit including means for increasing flow velocity of said second liquid as said second liquid flows between said inlet and outlet ends, said flow velocity increasing means creating a low pressure region;

(b) a second conduit having a connected end and an open end, the open end for placing into said first liquid in said container, the connected end forming a connection with said first conduit to provide fluid communication from said second conduit to said conduit, the connection between said first and second conduits being near said flow velocity increasing means so that the low pressure region in said first conduit causes said first liquid to rise in said second conduit and flow into said second liquid to remove said first liquid with said second liquid as said second liquid flows toward the outlet end of said first conduit.

2. Apparatus in accordance with claim 1 wherein said first conduit includes means for decreasing flow velocity, said decreasing means following said increasing means.

3. Apparatus in accordance with claim 1 wherein said increasing means forms a nozzle within said first conduit, said connection being located to direct flow of said first liquid into said second liquid in said first conduit between said nozzle of said increasing means and said decreasing means.

4. Apparatus in accordance with claim 1 including an on/off valve in said first conduit between said inlet end and said increasing means.

5. Apparatus in accordance with claim 2 including a check valve in said first conduit between said decreasing means and said outlet end.

6. Apparatus in accordance with claim 4 including means for flushing said container with said second liquid, said flushing means being attached between said first and second conduits.

7. Apparatus in accordance with claim 6 wherein said flushing means includes a third conduit and a sleeve surrounding at least a portion of said second conduit, said sleeve including means for directing said second liquid outwardly from said sleeve, said third conduit being in fluid communication with said first conduit in a region between said inlet end and said first on/off valve, said flushing means including a second on/off valve in said third conduit, said second on/off valve providing control for said flushing means.

8. Apparatus for removing a first liquid from a container, said apparatus being connected to a pressurized source of a second liquid, said apparatus comprising:

(a) a first conduit having inlet and outlet ends, said first conduit being connected to said pressurized source at said inlet end;

(b) means for creating a low pressure region in said first conduit between said inlet and outlet ends;

(c) a second conduit in fluid communication with said low pressure region in said first conduit, said second conduit having an open end for placing into said first liquid in said container, whereby the low pressure in said low pressure region draws said first liquid from said container through said second conduit into the stream of said second liquid in said first conduit;

(d) means, in fluid communication with said first conduit and in attachment with said second conduit, for flushing said container; and (e) means for switching said second liquid between said low pressure creating means and said flushing means, said switching means having a first position to allow said second liquid to create said low pressure region in said first conduit to draw said first liquid from said container through said second conduit, said switching means having a second position to function said flushing means to clean said container such that said second liquid used for cleaning may be exhausted like first liquid on again moving said switching means to said first position.

9. Apparatus in accordance with claim 8 wherein said low pressure creating means is a venturi nozzle in said first conduit.

10. Apparatus in accordance with claim 8 wherein said flushing means includes a bypass conduit and a sleeve, said sleeve surrounding a portion of said second conduit, said bypass conduit extending between said first conduit and said sleeve, said sleeve including openings through which second liquid exits.

11. Apparatus in accordance with claim 8 wherein said switching means includes a first on/off valve in said first conduit between said bypass conduit and said second conduit, said switching means further inluding a second on/off valve in said bypass conduit, whereby with said second on/off valve in an off position and said first on/off valve in an on position, said low pressure region is created, and with said first on/off valve in an off position and said second on/off valve in an on position, said flushing means functions to clean said container.

12. A method for removing a first liquid from a container using apparatus for receiving and directing the flow of a second liquid, said apparatus having a first conduit with inlet and outlet ends, said inlet end being in fluid communication with a pressurizing source of said second liquid, said first conduit including a first on/off valve and means for creating a low pressure region, said apparatus further including second conduit in fluid communication with said first conduit, said second conduit having an open end, said apparatus still further including a bypass conduit and a sleeve, said sleeve surrounding a portion of said second conduit and having openings therein, said bypass conduit being in fluid communication between said first conduit and said sleeve and including a second on/off valve, said method comprising the steps of:

(a) placing the open end of said second conduit in said second liquid in said container;

(b) opening said first on/off valve whereby second liquid is forced through said first conduit to create said low pressure region to draw said first liquid through said second conduit toward said low pressure region for mixing with said first liquid; and (c) closing said first on/off valve.

13. Method in accordance with claim 12 including the:

(a) opening said second on/off valve whereby said second liquid is forced from said openings in said sleeve;

(b) moving said apparatus so that said openings are moved to direct said second liquid to wash the interior of said container;

(c) closing said second on/off valve; and (d) repeating the steps of (a), (b) and (c) to remove the second liquid contained in said container.

* * * * *